US011284729B2

(12) United States Patent
Nishiyama et al.

(10) Patent No.: US 11,284,729 B2
(45) Date of Patent: Mar. 29, 2022

(54) DAMPER DEVICE SET AND COOLING AND/OR FREEZING SHOWCASE

(71) Applicant: SUGATSUNE KOGYO CO., LTD., Tokyo (JP)

(72) Inventors: Tomohiro Nishiyama, Tokyo (JP); Hiroki Nakayama, Tokyo (JP); Kazuaki Kashiwaguma, Tokyo (JP); Shuu Shimizu, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/480,339

(22) PCT Filed: Dec. 18, 2017

(86) PCT No.: PCT/JP2017/045272
§ 371 (c)(1),
(2) Date: Jul. 24, 2019

(87) PCT Pub. No.: WO2018/139103
PCT Pub. Date: Aug. 2, 2018

(65) Prior Publication Data

US 2019/0374047 A1 Dec. 12, 2019

(30) Foreign Application Priority Data

Jan. 24, 2017 (JP) ..... JP2017-009910

(51) Int. Cl.
*E05F 5/02* (2006.01)
*E05F 5/10* (2006.01)
(Continued)

(52) U.S. Cl.
CPC ..... *A47F 3/04* (2013.01); *E05F 1/10* (2013.01); *E05F 5/02* (2013.01); *E05F 5/08* (2013.01); *F25D 11/00* (2013.01); *F25D 23/02* (2013.01)

(58) Field of Classification Search
CPC ..... E05F 5/02; E05F 5/06; E05F 5/08; E05F 5/10; E05F 5/027; E05C 17/46; E05C 17/48; E05C 17/025; A47F 3/04
See application file for complete search history.

(56) References Cited

U.S. PATENT DOCUMENTS 2,244,787 A * 6/1941 Lakemacher ..... E05F 5/02 16/49
2,777,722 A * 1/1957 Burke ..... E05B 65/0046 292/332

(Continued)

FOREIGN PATENT DOCUMENTS

CN 1166564 A 12/1997
CN 103299016 A 9/2013

(Continued)

OTHER PUBLICATIONS

International Search Report, dated Mar. 6, 2018, from corresponding PCT application No. PCT/JP2017/045272.

(Continued)

*Primary Examiner* — Emily M Morgan
(74) *Attorney, Agent, or Firm* — Nixon & Vanderhye

(57) ABSTRACT

A damper device set is provided which can mount a damper device on a door that is thin and has a constraint on the mounting position. A first fastening member is used to fix a mounting plate to a door. A second fastening member placed at a position different from the first fastening member in a thickness direction of the door is used to fix, to the mounting plate, a damper device including a case and a linear damper (Continued)

housed in the case. At least part of the linear damper overlaps at least part of the first fastening member in plan view of the door.

13 Claims, 10 Drawing Sheets

(51) Int. Cl.

| | |
|---|---|
| ***A47F 3/04*** | (2006.01) |
| ***E05F 1/10*** | (2006.01) |
| *E05F 5/08* | (2006.01) |
| *F25D 11/00* | (2006.01) |
| *F25D 23/02* | (2006.01) |

(56) References Cited

U.S. PATENT DOCUMENTS

| | | | | |
|---|---|---|---|---|
| 3,256,554 | A * | 6/1966 | Turner | E05F 1/1261 16/273 |
| 5,904,411 | A | 5/1999 | Hayakawa | |
| 5,971,514 | A | 10/1999 | Hayakawa | |
| 6,408,483 | B1 * | 6/2002 | Salice | E05F 5/02 16/85 |
| 9,169,681 | B2 * | 10/2015 | Cooper | E05F 5/006 |
| 9,316,036 | B2 * | 4/2016 | Collene | E05F 5/10 |
| 10,458,167 | B2 * | 10/2019 | Collene | E05F 1/1261 |
| 2004/0227439 | A1 * | 11/2004 | Salice | E05F 5/02 312/333 |
| 2008/0289144 | A1 * | 11/2008 | Vanini | F24C 15/023 16/221 |
| 2008/0295283 | A1 * | 12/2008 | Tice | E05C 19/16 16/84 |
| 2011/0094056 | A1 * | 4/2011 | Lautenschlager | E05F 5/10 16/84 |
| 2013/0145695 | A1 * | 6/2013 | Wach | E05F 5/02 49/381 |
| 2014/0115823 | A1 * | 5/2014 | Lowe | E05F 5/006 16/85 |
| 2014/0115828 | A1 * | 5/2014 | Cheng | E05F 5/02 16/375 |
| 2014/0208542 | A1 * | 7/2014 | White | F24C 15/023 16/261 |
| 2017/0254133 | A1 * | 9/2017 | Liang | E05F 3/12 |

FOREIGN PATENT DOCUMENTS

| | | | | |
|---|---|---|---|---|
| CN | 103328752 | A | 9/2013 | |
| CN | 103924859 | A | 7/2014 | |
| CN | 104314403 | A | 1/2015 | |
| EP | 1 437 522 | A1 | 7/2004 | |
| EP | 2975203 | A1 * | 1/2016 | E05F 5/027 |
| JP | S59-21382 | U | 2/1984 | |
| JP | H02-33584 | Y2 | 9/1990 | |
| JP | H06-263186 | A | 9/1994 | |
| JP | H06-71841 | U | 10/1994 | |
| JP | H09-72155 | A | 3/1997 | |
| JP | H10-339075 | A | 12/1998 | |
| JP | 2591454 | Y2 | 3/1999 | |
| JP | 3750283 | B2 | 3/2006 | |
| JP | 2013-217085 | A | 10/2013 | |
| JP | 2013-231279 | A | 11/2013 | |
| JP | 5364107 | B2 | 12/2013 | |
| JP | 2015-124601 | A | 7/2015 | |
| JP | 5963300 | B2 | 8/2016 | |
| JP | 2016-211163 | A | 12/2016 | |
| WO | WO-2018142762 | A1 * | 8/2018 | E05F 1/14 |
| WO | WO-2019181303 | A1 * | 9/2019 | E05F 5/02 |

OTHER PUBLICATIONS

Office Action for Chinese Patent Application No. 201780084441.6 dated May 29, 2020 with English translation provided.

Office Action for Japanese Patent Application No. 2018-519998 dated Apr. 16, 2019 with English translation provided.

Office Action issued in Chinese Patent Application No. 201780084441.6 dated Jan. 7, 2021 with English translation provided.

* cited by examiner

DAMPER DEVICE SET AND COOLING AND/OR FREEZING SHOWCASE

TECHNICAL FIELD

The present invention relates to a damper device set that mitigates impact when a door closes, and a cooling and/or freezing showcase using the damper device set.

BACKGROUND ART

A cooling showcase for refrigerating beverages and/or a freezing showcase for freezing frozen food are installed in a convenience store, a supermarket, or the like. Double glazing is used for a door of the cooling and/or freezing showcase to ensure heat insulation properties and make it easy to see beverages or food in the cooling and/or freezing showcase. A peripheral portion of the double glazing is held by a frame member (also called a sash) (refer to Patent Literature 1).

The door using the double glazing is supported by a hinge provided to a frame of the cooling and/or freezing showcase in such a manner as to be openable and closable. A spring device that biases the door in a closing direction is provided between the frame and the door to prevent cold air in the cooling and/or freezing showcase from being released at the time of opening and closing (refer to Patent Literature 2).

CITATION LIST

Patent Literature

Patent Literature 1: Japanese Patent No. 3750283
Patent Literature 2: Japanese Utility Model Registration No. 2591454

SUMMARY OF INVENTION

Technical Problem

When a spring device that biases a door in a closing direction is placed, the door slams shut and impact is generated. It is desired to place a damper device on the door to mitigate the impact.

However, the door is thin. In addition, a cord heater for preventing condensation on a frame member (sash) is provided inside the frame member (sash) of the door. Accordingly, it is necessary to mount the damper device, avoiding the cord heater.

Hence, an object of the present invention is to provide a damper device set and a cooling and/or freezing showcase, where a damper device can be mounted on a door or frame that is thin and has a constraint on the mounting position.

Solution to Problem

In order to solve the above problem, the present invention is a damper device set that mitigates impact of closing of a door, the damper device set including: a mounting plate fixed to either one of a door and a frame using a first fastening member; and a damper device having a case and a linear damper housed in the case, the damper device being fixed to the mounting plate using a second fastening member placed at a position different from the first fastening member in a thickness direction of the one of the door and the frame.

Advantageous Effects of Invention

According to the present invention, the damper device is not fixed directly to the door or frame, but the first fastening member is used to mount the mounting plate on the door or frame. The second fastening member different from the first fastening member in position in the thickness direction of the door or frame is used to mount the damper device on the mounting plate. Accordingly, even if the door or frame is thin and has a constraint on the mounting position, it becomes possible to mount the damper device.

BRIEF DESCRIPTION OF DRAWINGS

FIG. 3 is a cross-sectional view taken along line III-III of FIG. 1

FIG. 4 is a perspective view of the damper device set of the embodiment

FIG. 6 is a plan view of the damper device set of the embodiment

FIG. 7 is a horizontal cross-sectional view of the damper device set of the embodiment

FIG. 8 is a process drawing illustrating the process of fixing a mounting plate to the door

FIG. 9 is a process drawing illustrating the process of fixing the damper device to the mounting plate

DESCRIPTION OF EMBODIMENTS

A damper device set of one embodiment of the present invention is described hereinafter on the basis of the accompanying drawings. However, the damper device set of the present invention can be embodied in various modes, and is not limited to the embodiment described in the description. The embodiment is provided with the intention of enabling those skilled in the art to fully understand the scope of the invention by fully disclosing the description.

Figure 1:
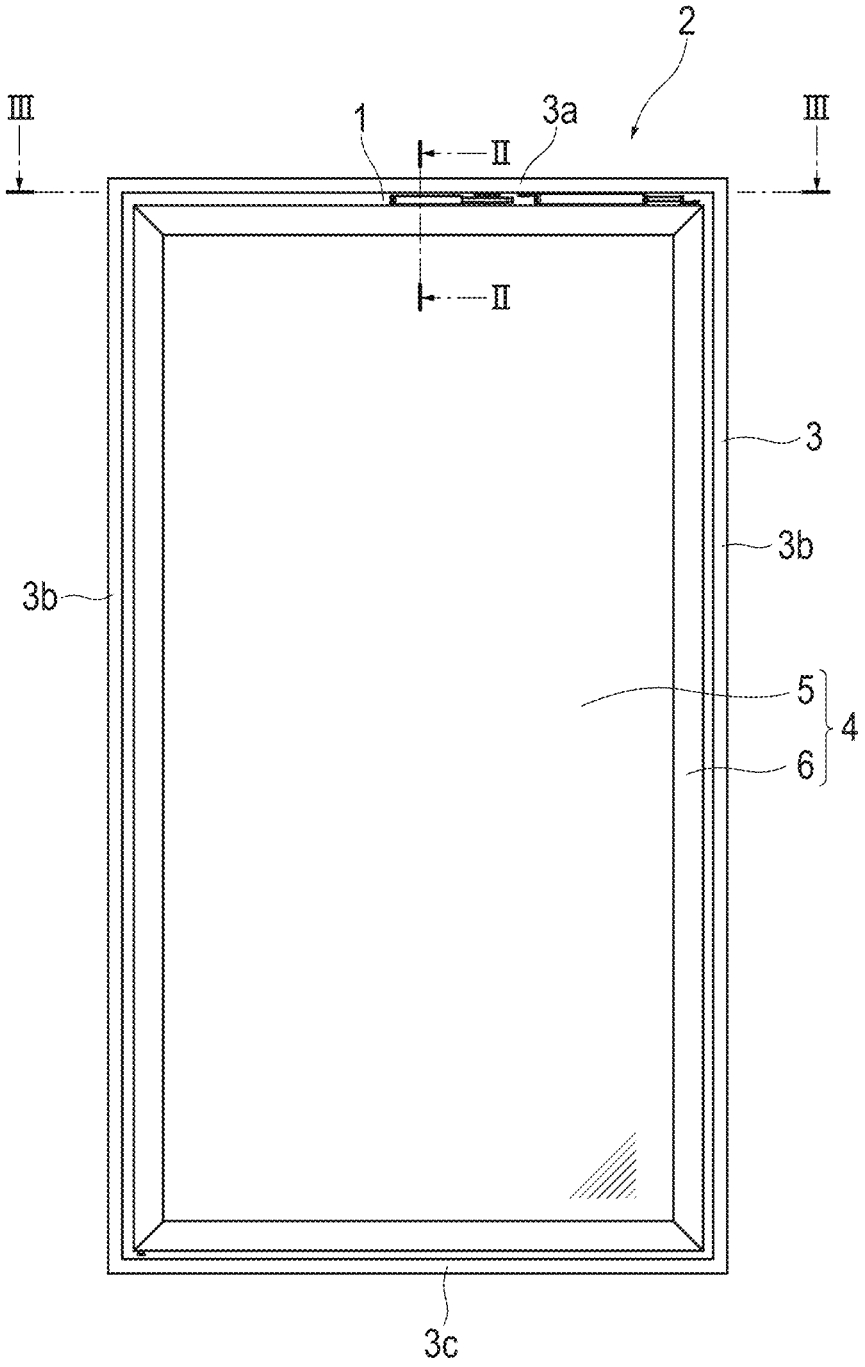
FIG. 1 is a front view of a reach-in door of a cooling and/or freezing showcase where a damper device set of one embodiment of the present invention is incorporated.
Figure 2:
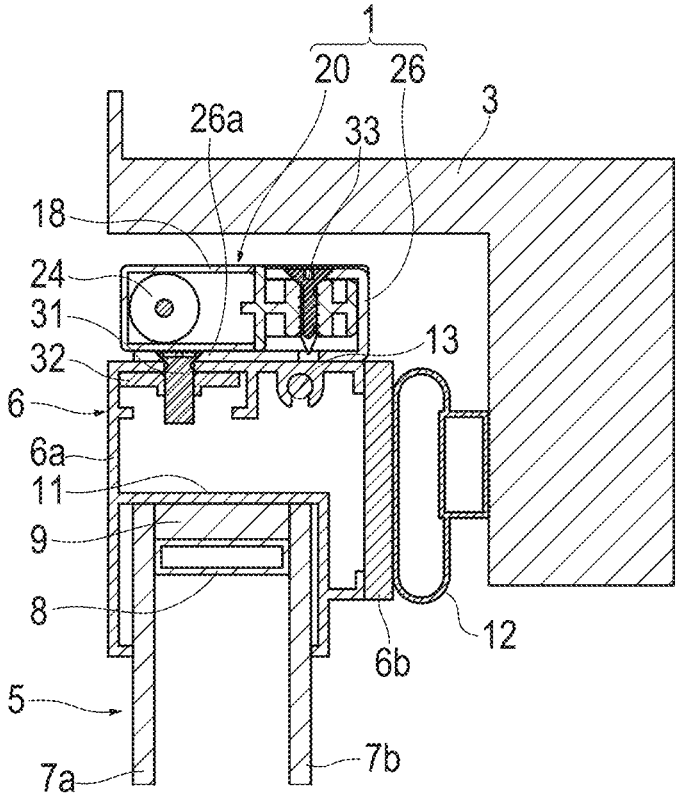
FIG. 2 is a cross-sectional view taken along line II-II of FIG. 1.

FIG. 1 is a front view of a reach-in door 2 of a cooling and/or freezing showcase where a damper device set 1 of the embodiment is incorporated (hereinafter simply referred to as the showcase). FIG. 2 is a cross-sectional view taken along line II-II of FIG. 1. FIG. 3 is a cross-sectional view taken along line III-III of FIG. 1.

As illustrated in FIG. 1, the reach-in door 2 includes a frame 3 and a door 4 that is supported by the frame 3 in such a manner as to be openable and closable. The frame 3 is formed in a rectangular shape in front view, and includes an upper frame 3*a*, a pair of left and right side frames 3*b*, and a lower frame 3*c*. The door 4 includes double glazing 5 that is excellent in heat insulating properties, and a rectangular frame-shaped frame member 6 (also called a sash) that holds a peripheral portion of the double glazing 5.

As illustrated in FIG. 2, the double glazing 5 includes a plurality of glass plates 7*a* and 7*b*, a spacer 8 that holds a gap between the glass plates 7*a* and 7*b*, and an adhesive sealant 9 that isolates the space between the glass plates 7*a* and 7*b* from the outside atmosphere. The frame member 6 is hollow, and is divided into two parts: a front side 6*a* and a back side 6*b*. A channel 11 that holds the peripheral portion of the double glazing 5 is provided to the front side 6*a*. A magnet gasket 12 for maintaining the inside of the showcase airtightly is mounted on the back side 6*b*. A cord heater 13 for preventing condensation on the frame member 6 is placed inside the frame member 6.

Figure 3A:
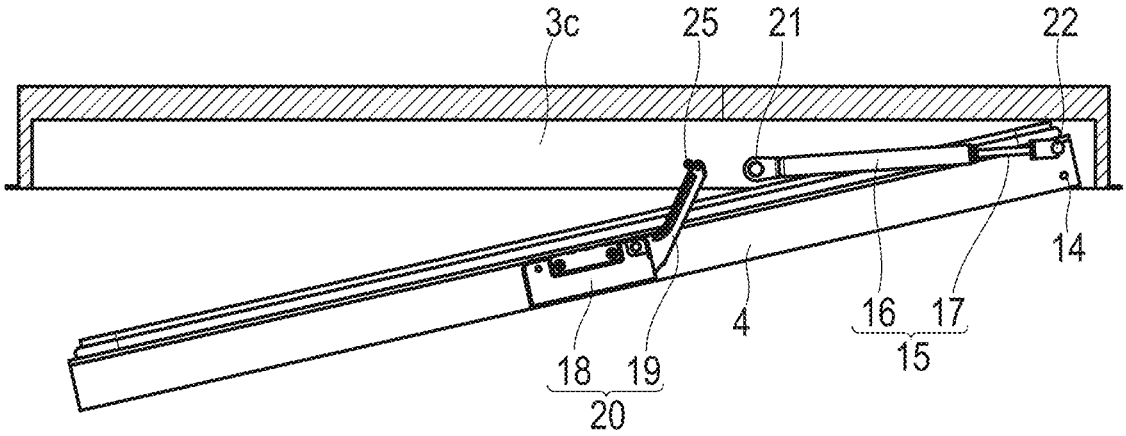
(FIG. 3A illustrates a door open position at a predetermined angle (an operation start position of a damper device)

As illustrated in FIG. 3, a hinge 14 on which the door 4 can open and close, a spring device 15 that pulls in the door 4 in a closing direction, and a damper device 20 that mitigates impact when the door 4 closes are provided between the upper frame 3*a* and the door 4. FIG. 3A is a cross-sectional view taken along line III-III slightly below the upper frame 3*a* of FIG. 1. The reference sign 3*c* of FIG. 3A denotes the lower frame. The spring device 15 is placed at a position close to the hinge 14, and the damper device 20 at a position farther away from the hinge 14 than the spring device 15.

The hinge 14 is, for example, a single-axis hinge, and supports the door 4 in such a manner as to be rotatable about the vertical axis.

The spring device 15 is, for example, a gas spring, and includes a cylinder 16 where a gas is sealed, and a piston rod 17 that can move in an axial direction with respect to the cylinder 16. A proximal end portion of the cylinder 16 is rotatably coupled to a shaft 21 fixed to the frame 3. A distal end portion of the piston rod 17 is rotatably coupled to a shaft 22 fixed to the door 4. The gas spring is a known one that pulls out the piston rod 17 by use of a reactive force generated by compressing gas. The gas spring pulls out the piston rod 17 to bias the door 4 in the closing direction. Instead of the gas spring, a coil spring type, a gravity type, or a torsion bar type spring device can also be used.

The damper device 20 includes a case 18, and an arm 19 that is rotatably supported by the case 18. The arm 19 can rotate between a pull-out position illustrated in FIG. 3A where a distal end of the arm 19 points toward the inside of the showcase, and a pull-in position illustrated in FIG. 3B where the arm 19 is parallel to the door 4. A linear damper 24 (refer to FIG. 2) is housed in the case 18, and operates when the arm 19 rotates in the closing direction.

Figure 3B:
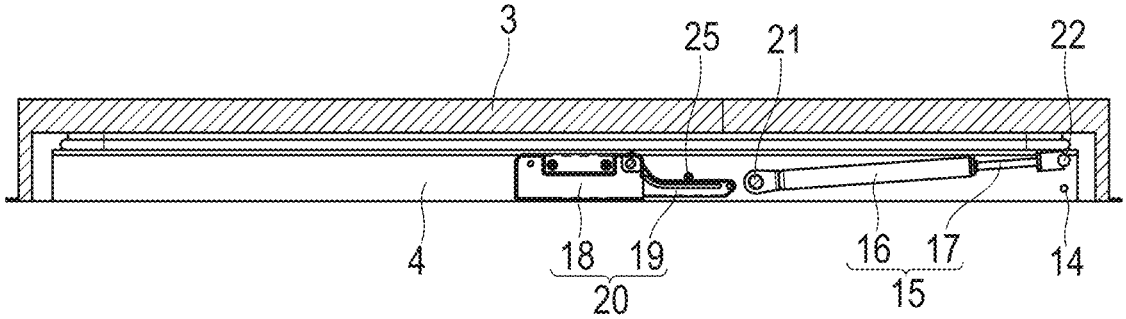
FIG. 3B illustrates a door closed position).

As illustrated in FIG. 3A, when the door 4 at an open position rotates to a predetermined position in the closing direction, the arm 19 comes into contact with a strike plate shaft 25 fixed to the frame 3, and the arm 19 starts rotating. The linear damper 24 operates with the rotation of the arm 19. The rotation of the arm 19 is braked, which mitigates the impact of the closing of the door 4. As illustrated in FIG. 3B, the braking of the rotation of the arm 19 continues until the door 4 closes.

Figure 4A:
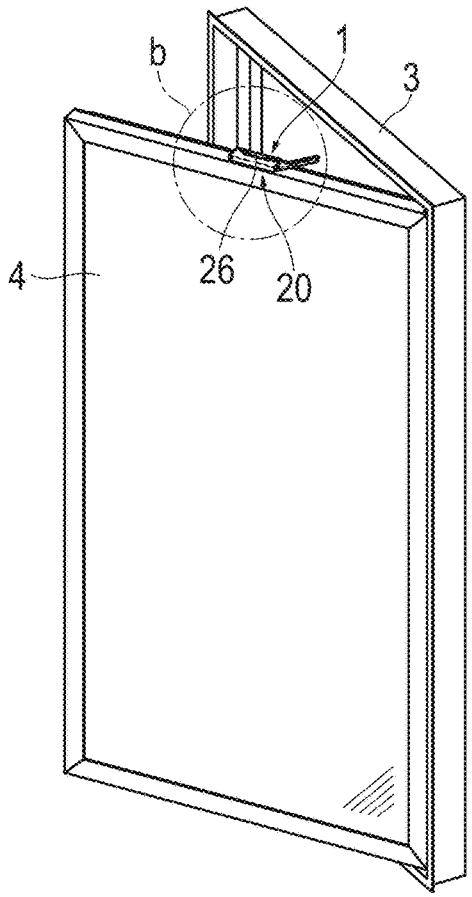
(FIG. 4A is a general view.
Figure 4B:
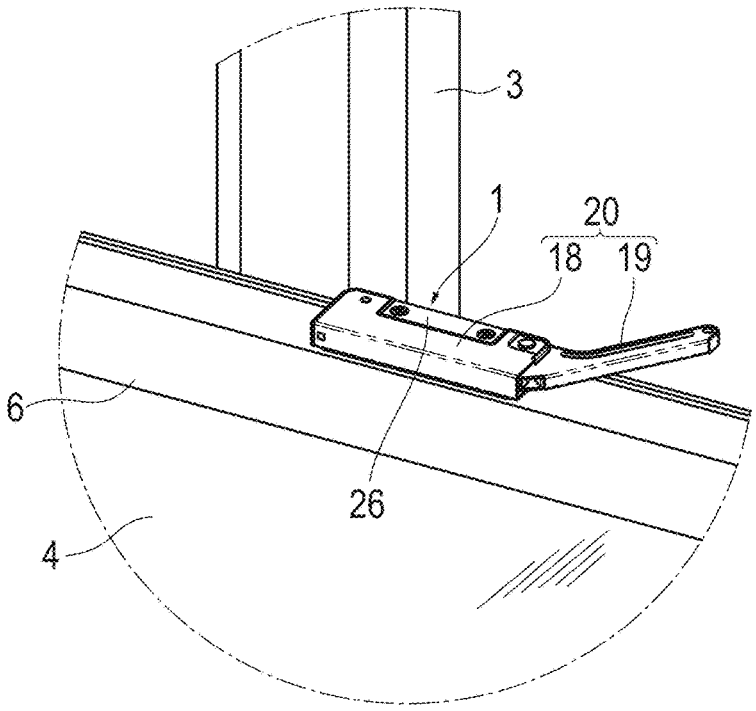
FIG. 4B is an enlarged view of a part b of FIG. 4A).

FIG. 4 is a perspective view of the damper device set 1. FIG. 4A is a general view, and FIG. 4B is an enlarged view of a part b of FIG. 4A.

As illustrated in FIG. 4, a mounting plate 26 is fixed to an upper surface of the frame member 6 of the door 4. The damper device 20 is fixed to the mounting plate 26. The mounting plate 26 and the damper device 20 configure the damper device set 1. The mounting plate 26 and the damper device 20 are placed within a thickness of the frame member 6 of the door 4 in the front-and-back direction (refer to FIG. 2).

Figure 5:
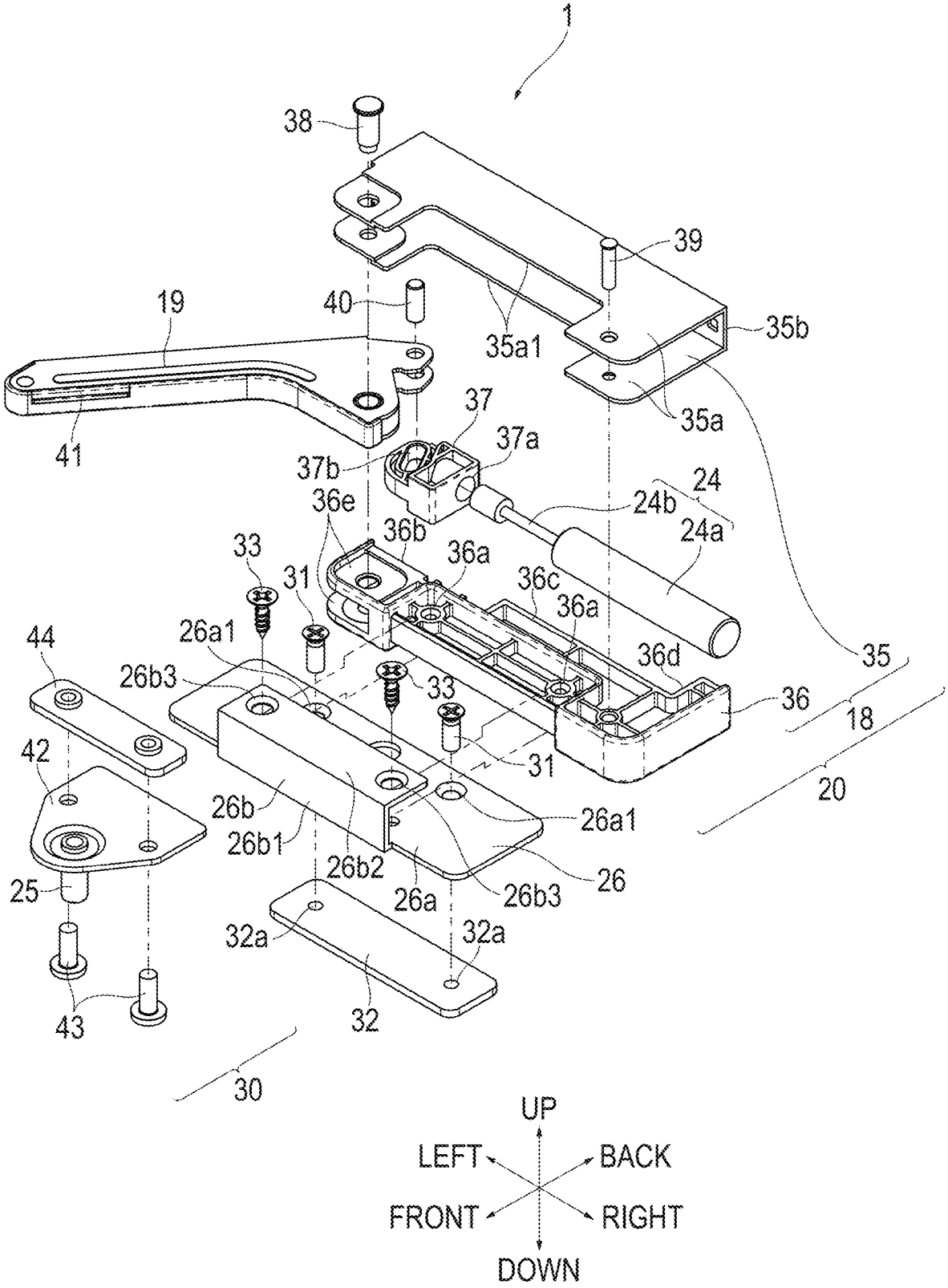
FIG. 5 is an exploded perspective view of the damper device set and a strike plate of the embodiment.

FIG. 5 illustrates an exploded perspective view of the damper device set 1. The reference sign 26 denotes the mounting plate, the reference sign 20 denotes the damper device, and a reference sign 30 denotes a strike plate. In the following description, the configuration of the damper device set 1 is described using directions as viewed from the back side of the door 4, that is, up and down, left and right, and front and back in FIG. 5 for convenience of description.

The mounting plate 26 is fixed to the door 4, using a plurality of first screws 31 as first fastening members. The mounting plate 26 is made of metal, and includes a rectangular base plate 26*a* that comes into contact with the upper surface of the door 4, and a bent piece 26*b* that, together with the base plate 26*a*, is bent into U-shape.

A plurality of through-holes 26*a*1 for the first screws 31 is formed in the base plate 26*a*. The first screw 31 is threadedly engaged with a female screw 32*a* of a back plate 32. The frame member 6 is sandwiched between the base plate 26*a* and the back plate 32 to fix the mounting plate 26 to the door 4 (refer to FIG. 2).

The bent piece 26*b* includes a side wall plate 26*b*1 that is square to the base plate 26*a*, and an upper wall plate 26*b*2 that is square to the side wall plate 26*b*1 and is parallel to the base plate 26*a*. The length of the bent piece 26*b* in the left-and-right direction is shorter than the length of the base plate 26*a* in the left-and-right direction. The length of the upper wall plate 26*b*2 of the bent piece 26*b* in the front-and-back direction is shorter than the length of the base plate 26*a* in the front-and-back direction. Apart of the damper device 20 is inserted into the bent piece 26*b*.

The damper device 20 is fixed to the bent piece 26*b*, using a plurality of second screws 33 as second fastening members. A plurality of through-holes 26*b*3 for the second screws 33 is formed in the upper wall plate 26*b*2 of the bent piece 26*b*.

The damper device 20 includes the case 18, the linear damper 24 that is housed in the case 18, the arm 19 that is rotatably supported by the case 18, and a slider 37 that extends and contracts the linear damper 24 in conjunction with the rotation of the arm 19.

The case 18 of the damper device 20 includes a case body 35 bent into U-shape in such a manner as to accommodate the linear damper 24, and a damper base 36 inserted into the case body 35.

The case body 35 is made of metal, and includes a pair of opposed walls 35*a* that oppose each other, and a coupling wall 35*b* that is square to the pair of opposed walls 35*a*. A notch 35*a*1 complementary to the upper wall plate 26*b*2 of the bent piece 26*b* is formed in the substantially rectangular opposed walls 35*a*.

The damper base 36 is made of resin, and has a thickness that allows it to be inserted into the case body 35. A female screw 36*a* that is threadedly engaged with the second screw 33 is formed in the damper base 36 of the damper device 20. A first wall 36*b*, a second wall 36*c*, and a damper receiver 36*d* are formed stepwise at a back end portion of the damper base 36. The slider 37 is slidably placed between the first wall 36*b* and the case body 35. The linear damper 24 is placed between the second wall 36*c* and the case body 35. The damper receiver 36*d* is in contact with a right end portion of a cylinder 24*a* of the linear damper 24.

A bifurcated portion 36*e* that sandwiches the arm 19 vertically is formed at one end portion of the damper base 36. A shaft 38 is fixed by fixing means such as caulking to the case body 35 and the bifurcated portion 36*e* of the damper base 36. The case body 35 and the damper base 36 are integrally coupled by the shaft 38 and a pin 39. The arm 19 is placed in the center of the case 18 in the up-and-down direction.

The linear damper 24 includes the cylinder 24*a* where oil is sealed, and a piston rod 24*b* that can move in the axial direction with respect to the cylinder 24*a*. The linear damper 24 is a known one where when a piston of the piston rod 24*b* moves in the cylinder 24*a*, the oil in the cylinder 24*a* passes through an orifice to generate a damper force. A return spring that returns the piston rod 24*b* to an extended position is provided in the cylinder 24*a*.

The arm 19 is formed to be long in one direction. A proximal end portion of the arm 19 is rotatably supported by the shaft 38. A coupling shaft 40 is mounted at a position away from the shaft 38 on the proximal end portion of the arm 19. A resin bumper 41 that mitigates impact when the arm 19 comes into contact with the strike plate shaft 25 is mounted on the distal end portion of the arm 19.

The slider 37 has a substantially cuboid shape. A blind insertion hole 37*a* where a distal end portion of the piston rod 24*b* of the linear damper 24 is inserted is formed in the slider 37. Moreover, a long hole 37*b* where the coupling shaft 40 is movably inserted is formed in the slider 37.

The strike plate 30 includes a washer 42 and the strike plate shaft 25 that is fixed to the washer 42. The strike plate 30 is fixed to the frame 3 (refer to FIG. 3). A screw 43 is threadedly engaged with a back plate 44. The frame 3 is sandwiched between the washer 42 and the back plate 44. Accordingly, the strike plate 30 is fixed to the frame 3.

FIG. 6 illustrates a plan view of the damper device set. FIG. 7 illustrates a horizontal cross-sectional view of the damper device set. In FIGS. 6 and 7, A illustrates a pull-out position of the arm 19, and B illustrates a pull-in position of the arm 19.

Figure 6A:
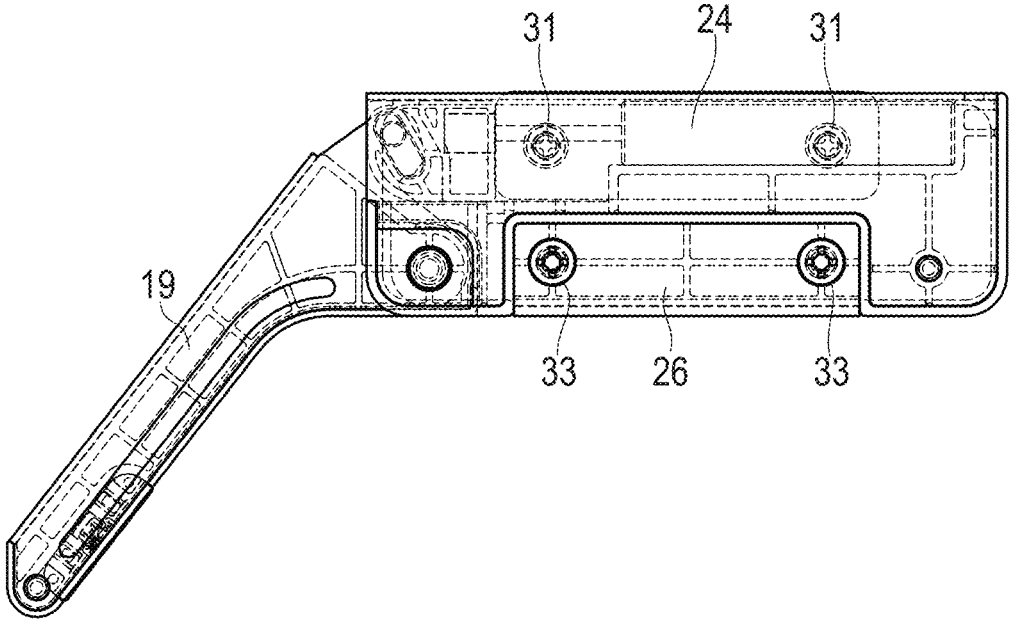
(FIG. 6A illustrates a pull-out position of an arm.
Figure 6B:
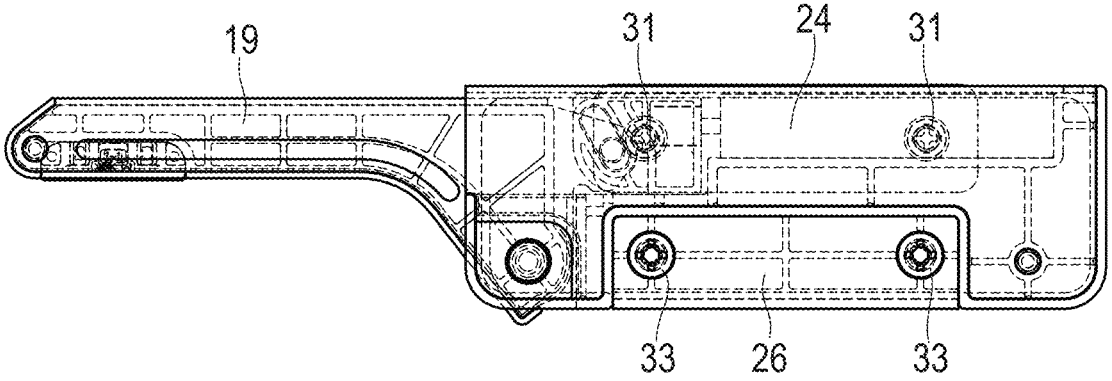
FIG. 6B illustrates a pull-in position of the arm).

As illustrated in FIGS. 6A and 6B, the first screw 31 is displaced from the second screw 33 in the front-and-back direction of the door 4. At least part of the first screw 31 overlaps at least part of the linear damper 24. However, the spacing between the first screws 31 and the spacing between the second screws 33 are not limited.

Figure 7A:
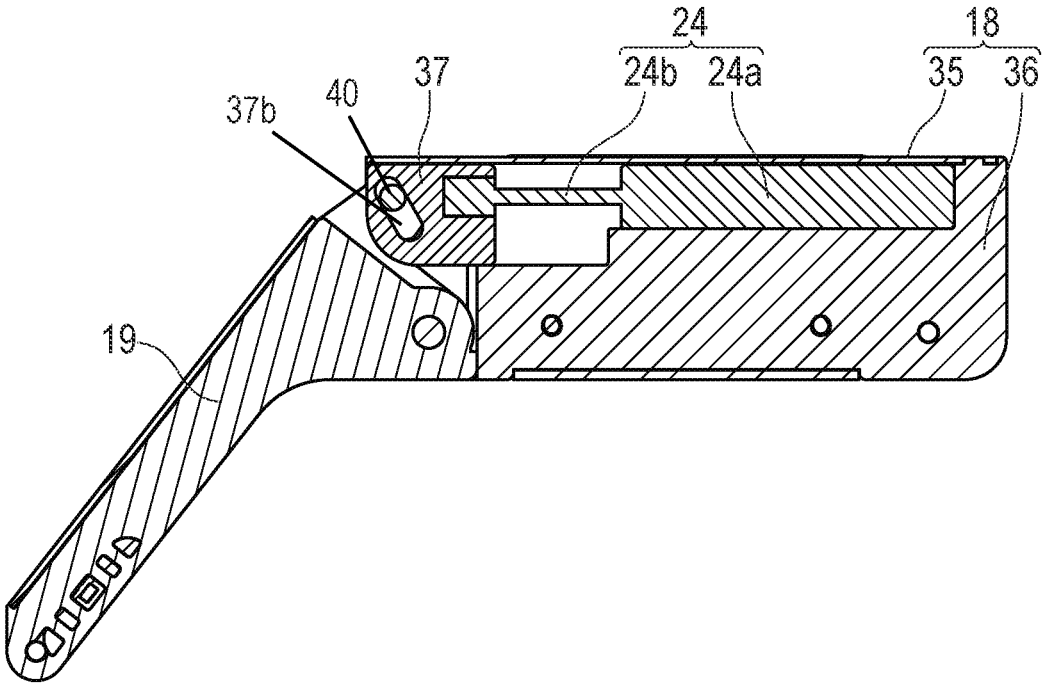
(FIG. 7A illustrates the pull-out position of the arm.
Figure 7B:
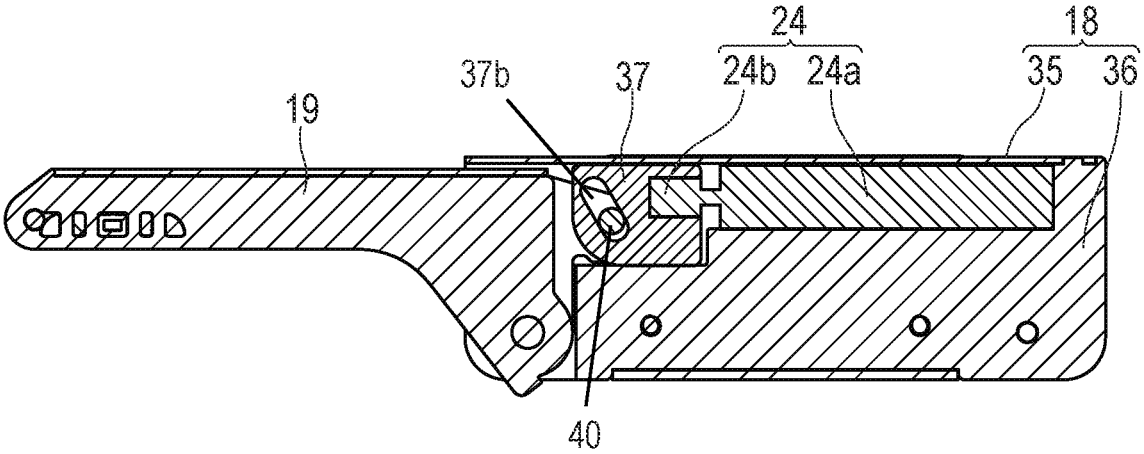
FIG. 7B illustrates the pull-in position of the arm).

As illustrated in FIG. 7A, the return spring of the linear damper 24 causes the piston rod 24*b* to extend. Accordingly, the arm 19 is at the pull-out position first. When the arm 19 comes into contact with the strike plate shaft 25 and the arm 19 rotates in the pull-in direction, the slider 37 slides in the case 18, and the linear damper 24 contracts. Consequently, a damper force is generated on the linear damper 24. The rotation of the arm 19 is braked. As illustrated in FIG. 7B, the braking of the rotation of the arm 19 continues up to the pull-in position of the arm 19.

Figure 8A:
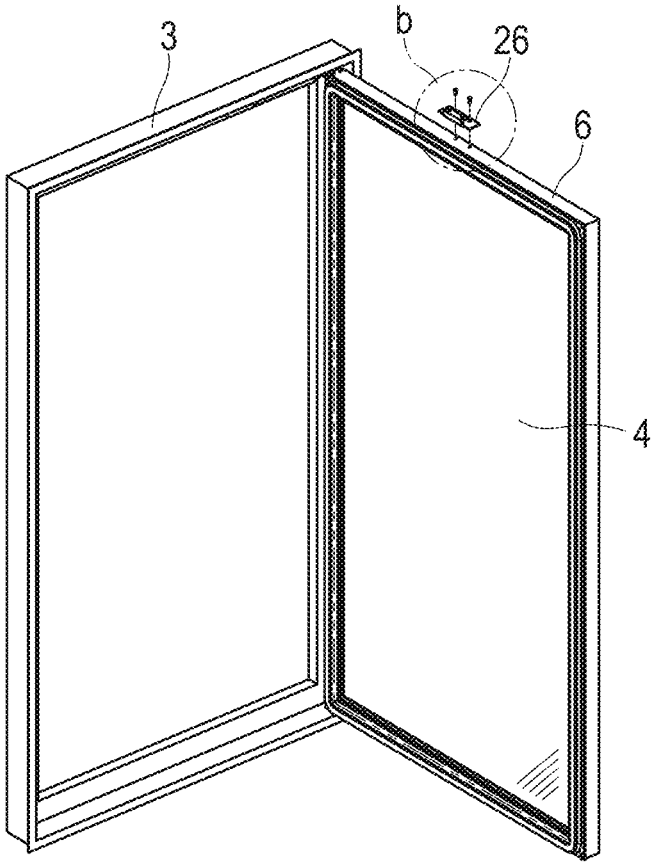
(FIG. 8A is a general view.
Figure 8B:
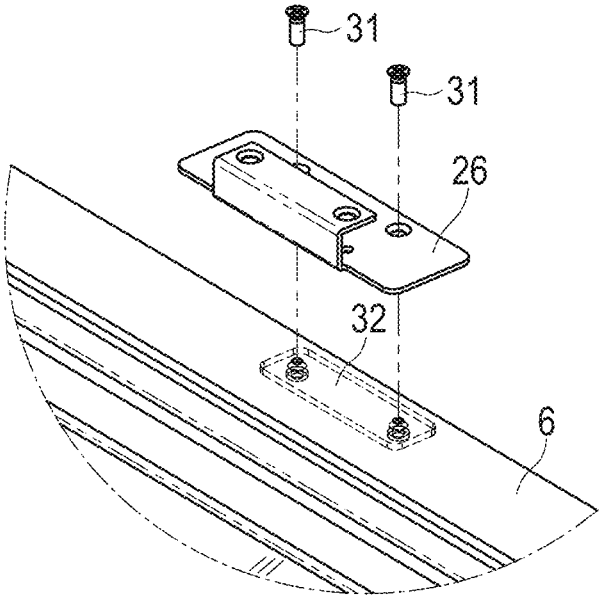
FIG. 8B is an enlarged view of a part b of FIG. 8A).

A method for mounting the damper device set 1 is described. As illustrated in FIG. 8, firstly, the mounting plate 26 is fixed to the frame member 6 of the door 4, using the first screws 31. Specifically, the mounting plate 26 is placed on the upper surface of the frame member 6 of the door 4, and the back plate 32 is inserted into the frame member 6. The first screws 31 are then passed through the mounting plate 26 and the frame member 6 to threadedly engage the first screws 31 with the back plate 32. Consequently, the frame member 6 is sandwiched between the mounting plate 26 and the back plate 32.

Figure 9A:
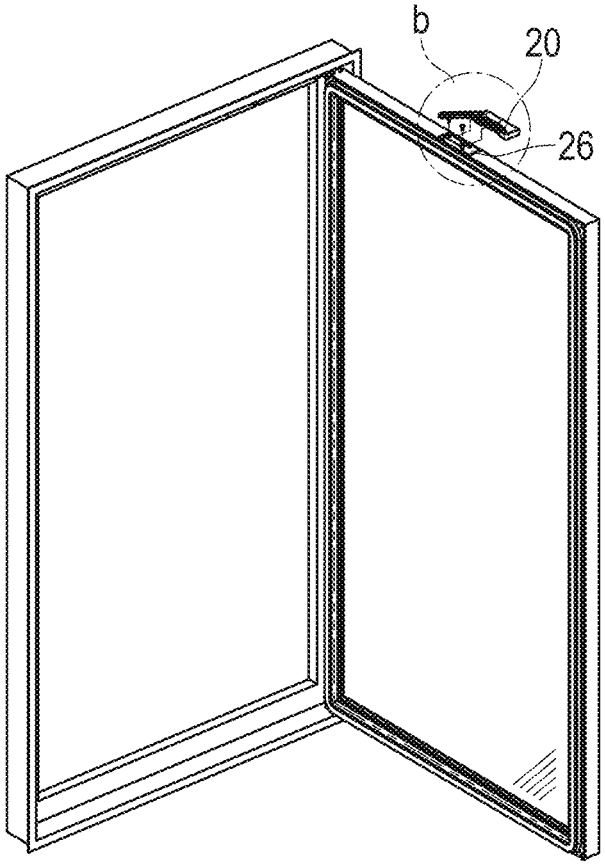
(FIG. 9A is a general view.
Figure 9B:
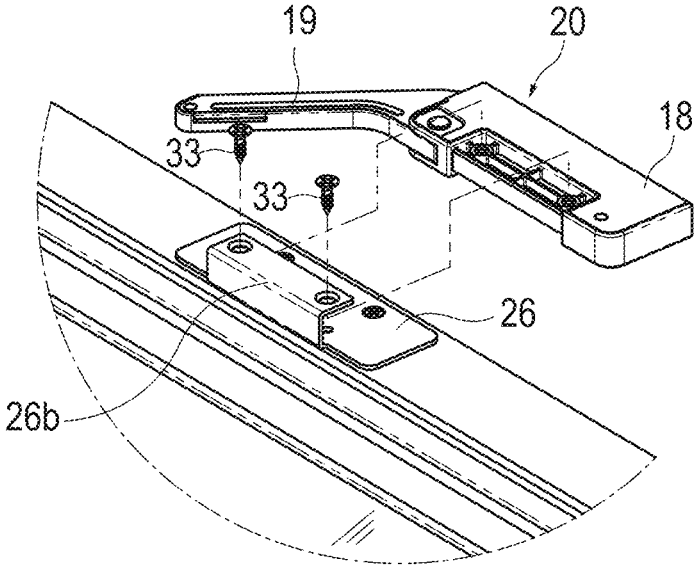
FIG. 9B is an enlarged view of a part b of FIG. 9A).

Next, as illustrated in FIG. 9, the damper device 20 is inserted into the bent piece 26*b* of the mounting plate 26. The damper device 20 is fixed to the mounting plate 26, using the second screws 33. Specifically, the second screws 33 are passed through the bent piece 26*b*. The second screws 33 are threadedly engaged with the damper base 36 of the damper device 20. The damper device 20 can be fixed to the mounting plate 26 in an upside down state so that the damper device 20 can be used for both of a right-hand door and a left-hand door. When the damper device 20 is fixed to the mounting plate 26, substantially the entire resin damper base 36 is covered by the metal case body 35 and the metal mounting plate 26.

Figure 10:
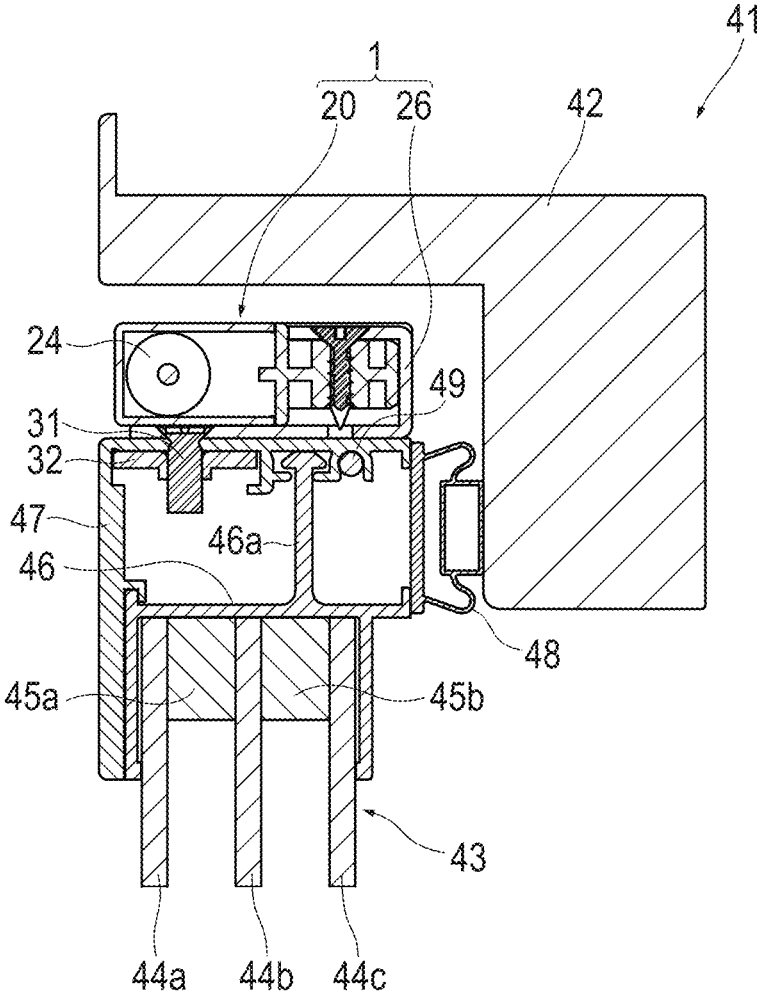
FIG. 10 is a cross-sectional view illustrating an example where the damper device set of the embodiment is mounted on a reach-in door of another example.

FIG. 10 illustrates an example where the damper device set 1 of the embodiment is mounted on a reach-in door of another example. The configuration of the damper device set 1 is the same as the one illustrated in FIG. 2. Accordingly, the same reference signs are assigned and their descriptions are omitted. A reach-in door 41 of this example includes a frame 42 and a door 43. The door 43 includes three glass plates 44*a*, 44*b*, and 44*c*, that is, the outer glass plate 44*a* placed on the exterior side of the showcase, the inner glass plate 44*c* placed on the interior side of the showcase, and the middle glass plate 44*b* placed between the outer glass plate 44*a* and the inner glass plate 44*c*. A spacer 45*a* for maintaining a gap between the outer glass plate 44*a* and the middle glass plate 44*b* is placed between the outer glass plate 44*a* and the middle glass plate 44*b*. A spacer 45*b* for maintaining a gap between the middle glass plate 44*b* and the inner glass plate 44*c* is placed between the middle glass plate 44*b* and the inner glass plate 44*c*. A holding member 46 holds peripheral portions of the three glass plates 44*a*, 44*b*, and 44*c*. The holding member 46 is supported by a frame member 47. A magnet gasket 48 is mounted on the frame member 47.

A cord heater 49 is placed inside the frame member 47. A protruding portion 46*a* that protrudes upward up to the left of the cord heater 49 and is engaged with the frame member 47 is provided to the holding member 46 to increase strength. The first screw 31 of the damper device set 1 is placed at a position avoiding the cord heater 49 and the protruding portion 46*a* of the holding member 46.

According to the damper device set 1 of the embodiment, the following effect is exerted. The linear damper 24 is placed along the left-and-right direction of the door 4 or 43. Accordingly, the damper device 20 having a great damper force can be placed on the thin door 4 or 43. As illustrated in FIG. 2, the cord heater 13 is placed inside the frame member 6 of the door 4. Moreover, as illustrated in FIG. 10, the cord heater 49 and the protruding portion 46*a* of the holding member 46 are placed inside the frame member 47 of the door 43. Accordingly, there is a constraint on the position where the damper device 20 is mounted on the door 4 or 43. The damper device 20 is not fixed directly to the door 4 or 43, but the mounting plate 26 is mounted on the door 4 or 43, using the first screws 31, and the damper device 20 is mounted on the mounting plate 26, using the second screws 33 different from the first screws 31 in position in the thickness direction of the door 4 or 43. Accordingly, even if a constraint on the mounting position is imposed on the door 4 or 43, it becomes possible to mount the damper device 20 (refer to claim 1).

In plan view of the door 4 or 43, at least part of the linear damper 24 of the damper device 20 overlaps at least part of the first screw 31. Accordingly, a space below the linear damper 24 can be effectively used as the mounting space (refer to claim 2).

The case 18 is configured including the case body 35 that is bent into U-shape in such a manner as to accommodate the linear damper 24, and the damper base 36 that is inserted into the case body 35. Accordingly, it is possible to encourage a reduction in the size of the damper device 20 (refer to claim 3).

The slider 37 that slides in conjunction with the rotation of the arm 19 is placed between the case body 35 and the damper base 36. Accordingly, it is possible to encourage a reduction in the size of the damper device 20 (refer to claim 4).

The damper device 20 can be fixed to the mounting plate 26 in the upside down state. Accordingly, the damper device 20 can be used for both of a right-hand door and a left-hand door (refer to claim 5).

The bent piece 26*b* that is bent into U-shape is formed on the mounting plate 26. Accordingly, it is easy to mount the damper device 20 on the mounting plate 26 (refer to claim 6).

The frame member 6 or 47 of the door 4 or 43 is sandwiched between the mounting plate 26 and the back plate 32. Accordingly, even if the frame member 6 or 47 is thin, the mounting plate 26 can be fixed to the frame member 6 or 47 (refer to claim 7).

The present invention is not limited to realization of the embodiment, and can be modified to various embodiments within the scope that does not change the gist of the present invention.

In the embodiment, the example where the damper device set is mounted on the door of the showcase is described. However, it is also possible to mount the damper device set on a door of a building or a door of furniture.

In the embodiment, the damper device set is mounted on the door, and the strike plate is mounted on the frame. However, it is also possible to mount the damper device set on the frame, and mount the strike plate on the door.

In the embodiment, the frame member of the door is sandwiched between the mounting plate and the back plate. However, it is also possible to fix the mounting plate to the frame member by forming a female screw in the frame member and threadedly engaging the first screw with the female screw of the frame member. Moreover, it is also possible to use a first fastening member having a head and an enlargeable portion instead of the first screw, turn the first fastening member, enlarge the enlargeable portion, and sandwich the mounting plate and the frame member of the door between the head and the enlargeable portion of the first fastening member.

In the embodiment, the slider is disposed between the arm and the linear damper. However, it is also possible to exclude the slider and bring the arm into direct contact with the linear damper.

The description is based on JP 2017-009910 A filed on Jan. 24, 2017, the entire contents of which are incorporated herein.

REFERENCE SIGNS LIST

1 Damper device set
2 Reach-in door
3 Frame
4 Door
5 Double glazing
6 Frame member of door
13 Cord heater
14 Hinge
15 Spring device
18 Case
19 Arm
20 Damper device
24 Linear damper
25 Strike plate shaft
26 Mounting plate
26*b* Bent piece
26*b*3 Through-hole
31 First screw (first fastening member)
32 Back plate
33 Second screw (second fastening member)
35 Case body
36 Damper base
37 Slider
41 Reach-in door
42 Frame
43 Door
47 Frame member of door

The invention claimed is:

1. A damper device set configured to be mounted on one of a frame and a door, the damper device set being configured to mitigate an impact of closing of the door that is rotatable with respect to the frame, the damper device set comprising:

a mounting plate fixed to either one of an upper surface of the door and a lower surface of the frame using a first fastening member; and a damper device fixed to the mounting plate using a second fastening member placed at a position different from the first fastening member in a thickness direction of the one of the door and the frame, the damper device including a case, a linear damper housed in the case, an arm pivotable about an axis that is perpendicular to the linear damper and configured to operate the linear damper, a slider disposed between the arm and the linear damper, the slider being configured to slide in conjunction with rotation of the arm, the slider including a slider hole defined therethrough, and a coupling shaft inserted within the slider hole defined in the slider and on the arm, the coupling shaft configured to move within the slider hole defined in the slider.

2. The damper device set according to claim 1, wherein at least part of the linear damper overlaps at least part of the first fastening member in plan view of the one of the door and the frame.

3. The damper device set according to claim 2, wherein the case has a case body bent into U-shape to accommodate the linear damper, and a damper base inserted into the case body.

4. The damper device set according to claim 3, wherein the arm is configured to rotate with a closing operation of the door, and the slider is disposed between the case body and the damper base.

5. The damper device set according to claim 1, wherein the mounting plate has a base plate configured to be mounted to the door, and a bent piece that, together with the base plate, is bent into U-shape, and a through-hole for the second fastening member is formed in the bent piece.

6. The damper device set according to claim 1, wherein the door includes a frame member that is different from the frame, and the frame member of the door is sandwiched between the mounting plate and a back plate configured to be threadedly engaged with the first fastening member.

7. A reach-in door of a cooling and/or freezing showcase, the reach-in door comprising:

the damper device set according to claim 1;

a spring device configured to pull in the door in a closing direction; and a frame member which is different from the frame, wherein the first fastening member is provided at a position avoiding a cord heater provided in the frame member of the door.

8. The damper device set according to claim 2, wherein the mounting plate has a base plate configured to be mounted to the door, and a bent piece that, together with the base plate, is bent into U-shape, and a through-hole for the second fastening member is formed in the bent piece.

9. The damper device set according to claim 3, wherein the mounting plate has a base plate configured to be mounted to the door, and a bent piece that, together with the base plate, is bent into U-shape, and a through-hole for the second fastening member is formed in the bent piece.

10. The damper device set according to claim 4, wherein the mounting plate has a base plate configured to be mounted to the door, and a bent piece that, together with the base plate, is bent into U-shape, and a through-hole for the second fastening member is formed in the bent piece.

11. The damper device set according to claim 2, wherein the door includes a frame member that is different from the frame, and the frame member of the door is sandwiched between the mounting plate and a back plate configured to be threadedly engaged with the first fastening member.

12. The damper device set according to claim 3, wherein the door includes a frame member that is different from the frame, and the frame member of the door is sandwiched between the mounting plate and a back plate configured to be threadedly engaged with the first fastening member.

13. The damper device set according to claim 4, wherein the door includes a frame member that is different from the frame, and the frame member of the door is sandwiched between the mounting plate and a back plate configured to be threadedly engaged with the first fastening member.

* * * * *